US010913038B2

(12) United States Patent
Lau

(10) Patent No.: US 10,913,038 B2
(45) Date of Patent: Feb. 9, 2021

(54) BOTTOM-TO-TOP LIQUID FILLING SYSTEM

(71) Applicant: GUANOVATION LIMITED, HongKong (CN)

(72) Inventor: Yuk Hang Lau, HongKong (CN)

(73) Assignee: GUANOVATION LIMITED, Hong Kong (HK)

( * ) Notice: Subject to any disclaimer, the term of this patent is extended or adjusted under 35 U.S.C. 154(b) by 0 days.

(21) Appl. No.: 16/420,142

(22) Filed: Jul. 5, 2019

(65) Prior Publication Data

US 2019/0352162 A1 Nov. 21, 2019

Related U.S. Application Data

(63) Continuation of application No. PCT/CN2016/108588, filed on Dec. 5, 2016.

(30) Foreign Application Priority Data

Dec. 29, 2015 (HK) ..... 15112780.2

(51) Int. Cl.
*B67D 1/00* (2006.01)
*B67D 1/08* (2006.01)
(Continued)

(52) U.S. Cl.
CPC ..... *B01F 3/04808* (2013.01); *B01F 3/04737* (2013.01); *B01F 5/20* (2013.01);
(Continued)

(58) Field of Classification Search
CPC ..... B67D 1/0894; B67D 1/0082; B67D 2210/00065
See application file for complete search history.

(56) References Cited

U.S. PATENT DOCUMENTS

2011/0121020 A1* 5/2011 Springer ..... B67D 1/0007 222/1

* cited by examiner

*Primary Examiner* — Craig M Schneider
*Assistant Examiner* — Jason K Niesz

(57) ABSTRACT

Disclosed is a bottom-up liquid filling system, comprising an upper body and a lower body. The upper body comprises a fixed member and a lifting member with a filling passage channel in the middle, wherein the fixed member is fixedly arranged on an inner bottom face of the upper body, the lifting member is arranged inside the fixed member and is movable up and down, a passage hole is arranged in a side wall of the lifting member, and the filling passage channel passes through the bottom of the upper body. The lower body comprises a capping plug, a rigid cylinder, an outer retractable tube and an inner retractable tube, wherein the outer retractable tube is internally provided with a spring, the rigid cylinder is arranged on a top plate and is provided with a channel, the inner retractable tube is arranged inside the outer retractable tube and is in communication with the rigid cylinder, a support cylinder is arranged on a bottom plate, the support cylinder passes through the inner retractable tube and extends into the rigid cylinder, the capping plug connected to the top of the rigid cylinder is fixedly arranged at the top of the support cylinder, and an outer side wall of the capping plug is snap-fitted with an inner side wall of the top of the lifting member. The present invention has the advantages of being less prone to leakage and spilling, having low costs and reducing the chance of scalding.

18 Claims, 6 Drawing Sheets

(51) Int. Cl.
*B01F 3/04* (2006.01)
*B01F 5/20* (2006.01)

(52) U.S. Cl.
CPC ..... *B67D 1/0082* (2013.01); *B67D 1/0894* (2013.01); *B01F 2003/04872* (2013.01); *B67D 2210/00065* (2013.01)

BOTTOM-TO-TOP LIQUID FILLING SYSTEM

TECHNICAL FIELD

The present invention relates to a liquid/semi-liquid filling system, and in particular to a bottom-up liquid filling system.

BACKGROUND ART

In the past and at present, most of restaurants, soda machines, coffee shops, beverage kiosks, etc. on the market use electrical, mechanical and other types of filling instruments or apparatuses to sell drinks. At present, the following problems exist: firstly, how to achieve the same function in a more efficient way, but also taking reducing the waste caused by leakage and spilling when a cup container is filled from top to bottom by traditional soda machines or any water dispensers which are used in various shops, restaurants or coffee shops into consideration; secondly, how to reduce the investment amount of traditional water/beverage filling apparatuses and the long-term electricity cost; and finally, how to reduce the chance of scalding occurring when filling with a high-temperature liquid.

SUMMARY OF THE INVENTION

In order to overcome the above defects, an object of the present invention is to provide a bottom-up liquid filling system which can perform filling from bottom to top and has the advantages of being less prone to leakage and spilling, having low costs and reducing the chance of scalding.

In order to achieve the above object, the technical solution used in the present invention is: a bottom-up liquid filling system, which comprises an upper body and a lower body, wherein the upper body comprises a fixed member and a lifting member, the fixed member is fixedly arranged on an inner bottom face of the upper body, the lifting member is arranged inside the fixed member and is movable up and down, a passage hole is arranged in a side wall of the lifting member, a filling passage channel is arranged in the middle of the lifting member, and the filling passage channel passes through the bottom of the upper body; and the lower body comprises a capping plug, a rigid cylinder, an outer retractable tube and an inner retractable tube, the outer retractable tube comprises a top plate, a bottom plate and a side wall for connecting the two, a spring is provided between the top plate and the bottom plate, the rigid cylinder is arranged on the top plate, the rigid cylinder is internally provided with a channel, the inner retractable tube is arranged inside the outer retractable tube and is in communication with the rigid cylinder, a support foundation is arranged on the bottom plate, a support cylinder is arranged on the support foundation, the support cylinder passes through the inner retractable tube and extends into the rigid cylinder, the capping plug is fixedly arranged at the top of the support cylinder, the capping plug is fixedly connected to the top of the rigid cylinder, the rigid cylinder is located inside the lifting member, and an outer side wall of the capping plug is snap-fitted with an inner side wall of the top of the lifting member.

The bottom-up liquid filling system of the present invention has the following beneficial effects: the system cooperates with a pump during use, the upper body is pressed downwards, the fixed member moves downwards with the upper body, the inner and outer retractable tubes are compressed, the spring is compressed, and accordingly, the rigid cylinder drives the lifting member to move upwards via the capping plug, the passage hole is exposed outside, and at this time, a liquid/semi-liquid can flow from the lower body to the upper body and is discharged from the passage hole, thereby completing the filling operation. The bottom-up liquid filling system can be applied to the filling of, including but limited to, various types of water, beverages, or other liquids/semi-liquids, as well as ice cream and smoothie machines, and allows for a fast filling speed, a high filling efficiency and a high safety performance, i.e. being able to reduce problems such as splashing of a high-temperature liquid produced during filling and a user then being scalded; at the same time, the method of filling from bottom to top reduces the leakage and spilling during filling, and greatly reduces the amount of foam produced during the filling of a carbonic acid liquid, so as to eliminate the action of liquid backflow; in conjunction with a simple natural water flow principle, the liquid is filled from a liquid supply source into the upper body of this design; and in the application of this design, the traditional method for pouring beverages, drinks and other kinds of liquid, as well as semi-liquid materials, from top to bottom can be surmounted, and the system is easy to operate.

Preferably, a first leakproof ring is provided at the connection between the capping plug and the rigid cylinder to avoid the leakage of a liquid/semi-liquid from the connection between the capping plug and the rigid cylinder.

Preferably, a second leakproof ring is provided at the connection between the rigid cylinder and the top plate to avoid the leakage of the liquid/semi-liquid from the connection between the top plate and the rigid cylinder.

Preferably, an annular boss is provided on an outer side of the top of the lifting member, and a lower end face of the boss and an upper end face of the fixed member vertically correspond to and are capable of coming into contact with each other. The boss can be configured to limit the downward movement of the lifting member, so that the lifting member is unable to keep moving downwards.

Preferably, a limiting projection is provided on an outer side of the bottom of the lifting member, an inner side wall of the fixed member is provided with a sliding groove, the sliding groove starts from the bottom of the fixed member and terminates at an upper part of the inner side wall of the fixed member, and the limiting projection is slidable up and down in the sliding groove. A limit is provided for the upward movement of the lifting member, so that the lifting member is unable to keep moving upwards.

Preferably, the outer side wall of the capping plug is snap-fitted with the inner side wall of the top of the lifting member by fitting a snap-in area with a raised area. With the arrangement of the snap-in area and the raised area, the structure is simple, and the connection between the capping plug and the lifting member is relatively secure.

Preferably, the inner retractable tube is made of an elastic material.

Preferably, further comprising an internal channel and a rubber connecting tube, wherein the internal channel is fixedly connected to the bottom plate and is in communication with the rigid cylinder, and the rubber connecting tube is in communication with the bottom of the internal channel. A pressure pump is used to discharge the liquid/semi-liquid from the rubber connecting tube, the internal channel, the inner retractable tube and the rigid cylinder to the filling passage channel of the fixed member.

10—Upper body 11—Lifting member 12—Fixed member 13—Boss 14—Snap-in area 15—Filling passage channel 16—Passage hole 17—Limiting projection 18—Sliding groove 20—Lower body 21—Capping plug 22—Rigid cylinder 23—Support cylinder 24—Outer retractable tube 24*a*—Top plate 24*b*—Bottom plate 24*c*—Side wall 25—Spring 26—Inner retractable tube 27—Support foundation 28—Internal channel 29—Rubber connecting tube 210—Raised area 211—First leakproof ring 212—Second leakproof ring

DETAILED DESCRIPTION OF EMBODIMENTS

A preferred embodiment of the present invention will be described in detail in conjunction with the accompanying drawings, such that the advantages and features of the present invention will be easier to understand for a person skilled in the art, so as to define the scope of protection of the present invention more clearly.

With reference to FIGS. 1-6, a bottom-up liquid filling system comprises two parts, which are respectively an upper body 10 and a lower body 20.

Figure 1:
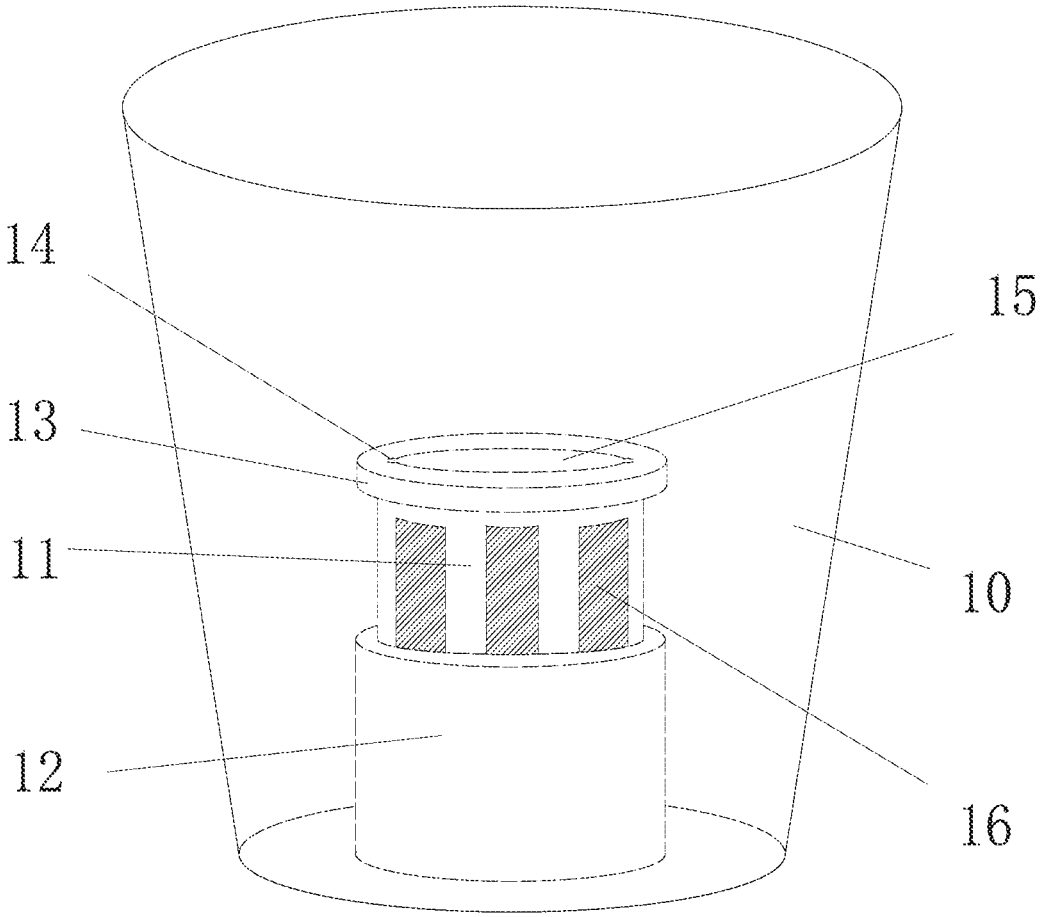
FIG. 1 is a structural schematic view of an upper body of this embodiment in a circulation state.

As shown in FIG. 1, the upper body 10 comprises a fixed member 12 and a lifting member 11, wherein the fixed member 12 is fixedly arranged on an inner bottom face of the upper body 10, and the lifting member 11 is arranged inside the fixed member 12 and can move up and down. In this embodiment, both the fixed member 12 and the lifting member 11 are annular, but can certainly also be configured in another shape. A passage hole 16 for implementing filling is arranged in a side wall of the lifting member 11, a filling passage channel 15 is arranged in the middle of the lifting member 11, and the filling passage channel 15 passes through the bottom of the upper body 10.

Figure 6:
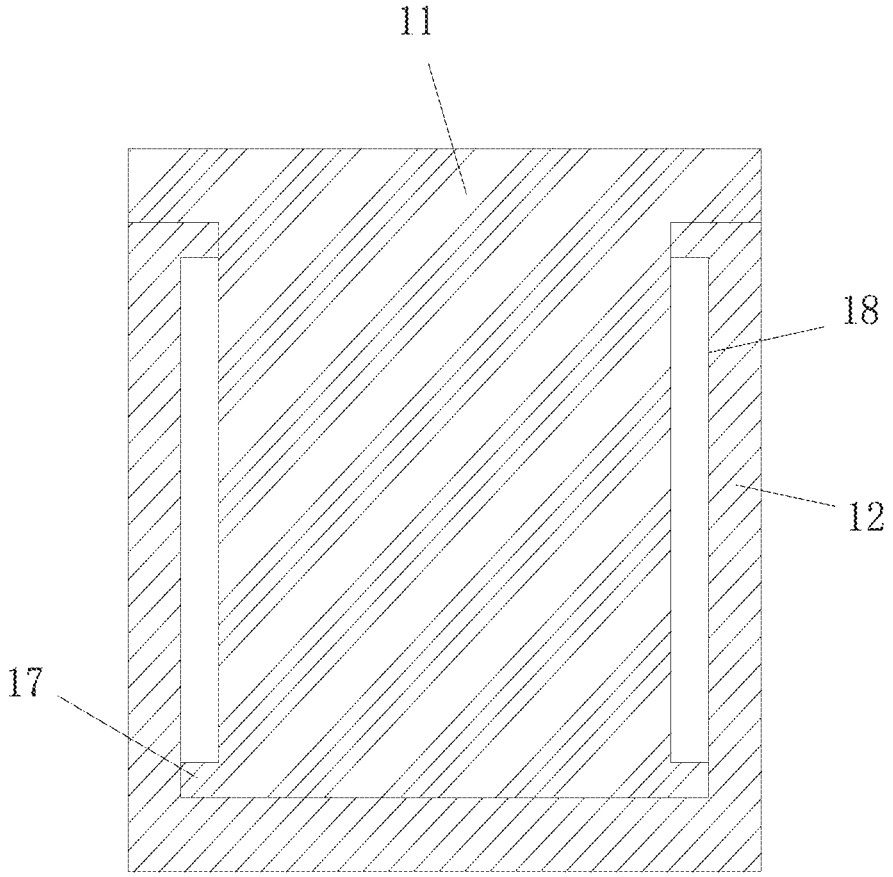
FIG. 6 is a sectional view of this embodiment where a lifting member moves down and then cooperates with a fixed member.

The lifting member 11 can be lifted up and down, and in this embodiment, limiting structures are provided for both the upward and downward movement of the lifting member 11. The limiting structure for the lifting member 11 after same moves downwards is such that an annular boss 13 is provided on an outer side of the top of the lifting member 11, and a lower end face of the boss 13 and an upper end face of the fixed member 12 vertically correspond to and are capable of coming into contact with each other, so that, when moving down until the boss 13 comes into contact with the upper end face of the fixed member 12, the lifting member 11 is unable to move downwards any more, and the downward movement of the lifting member 11 is then limited. As shown in FIG. 6, the limiting structure for the lifting member 11 after same moves up is such that a limiting projection 17 is provided on an outer side of the bottom of the lifting member 11, an inner side wall of the fixed member 12 is provided with a sliding groove 18, the sliding groove 18 starts from the bottom of the fixed member 12 and terminates at an upper part of the inner side wall of the fixed member 12, and the limiting projection 17 can be slid up and down in the sliding groove 18, so that when the lifting member 11 moves upwards until the limiting projection 17 abuts against the upper part of the sliding groove 18, the lifting member 11 cannot move upwards any more, and the upward movement of the lifting member 11 is then limited.

Figure 2:
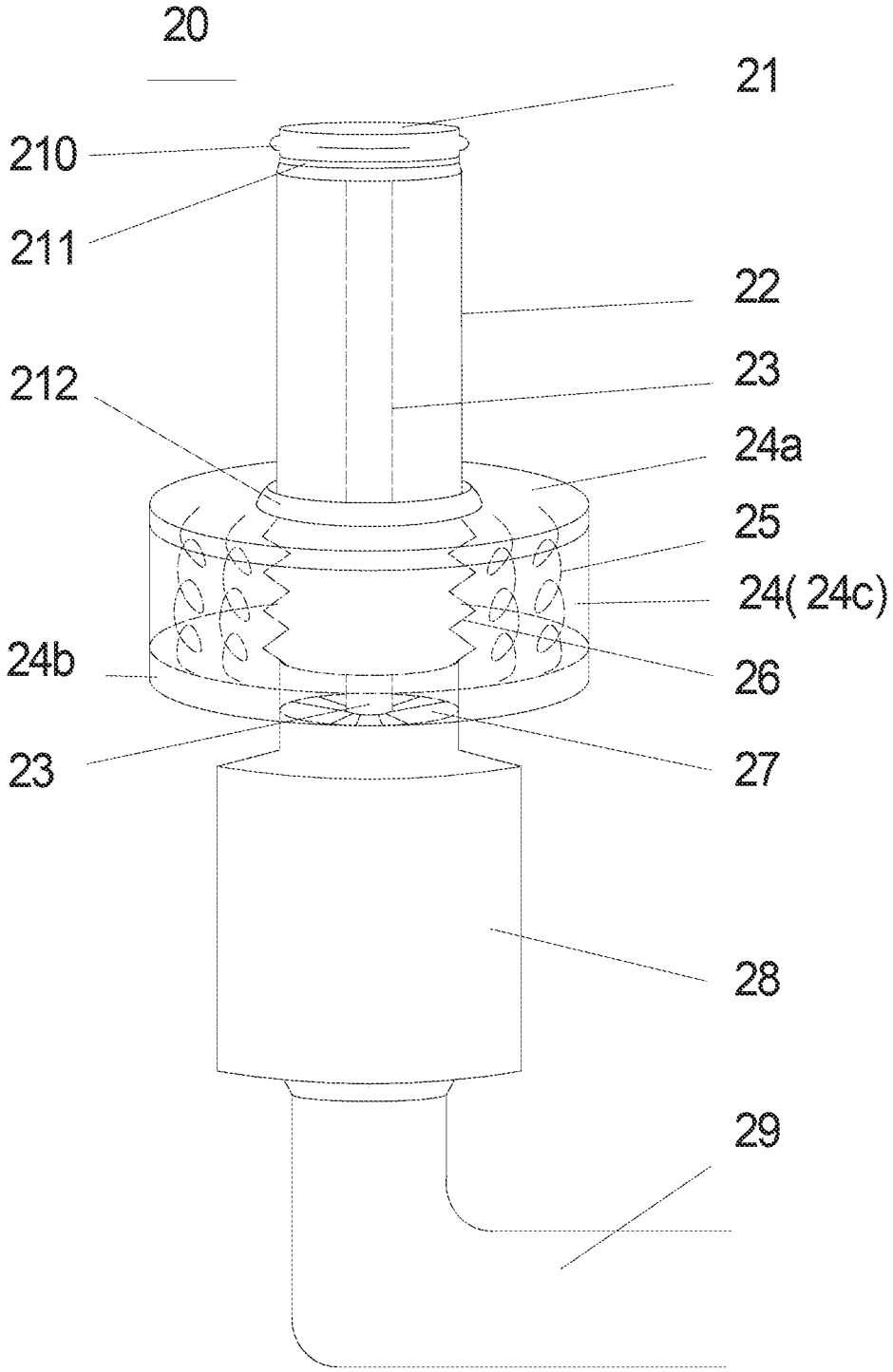
FIG. 2 is a structural schematic view of a lower body of this embodiment with a spring and inner and outer retractable tubes in a compressed state.
Figure 3:
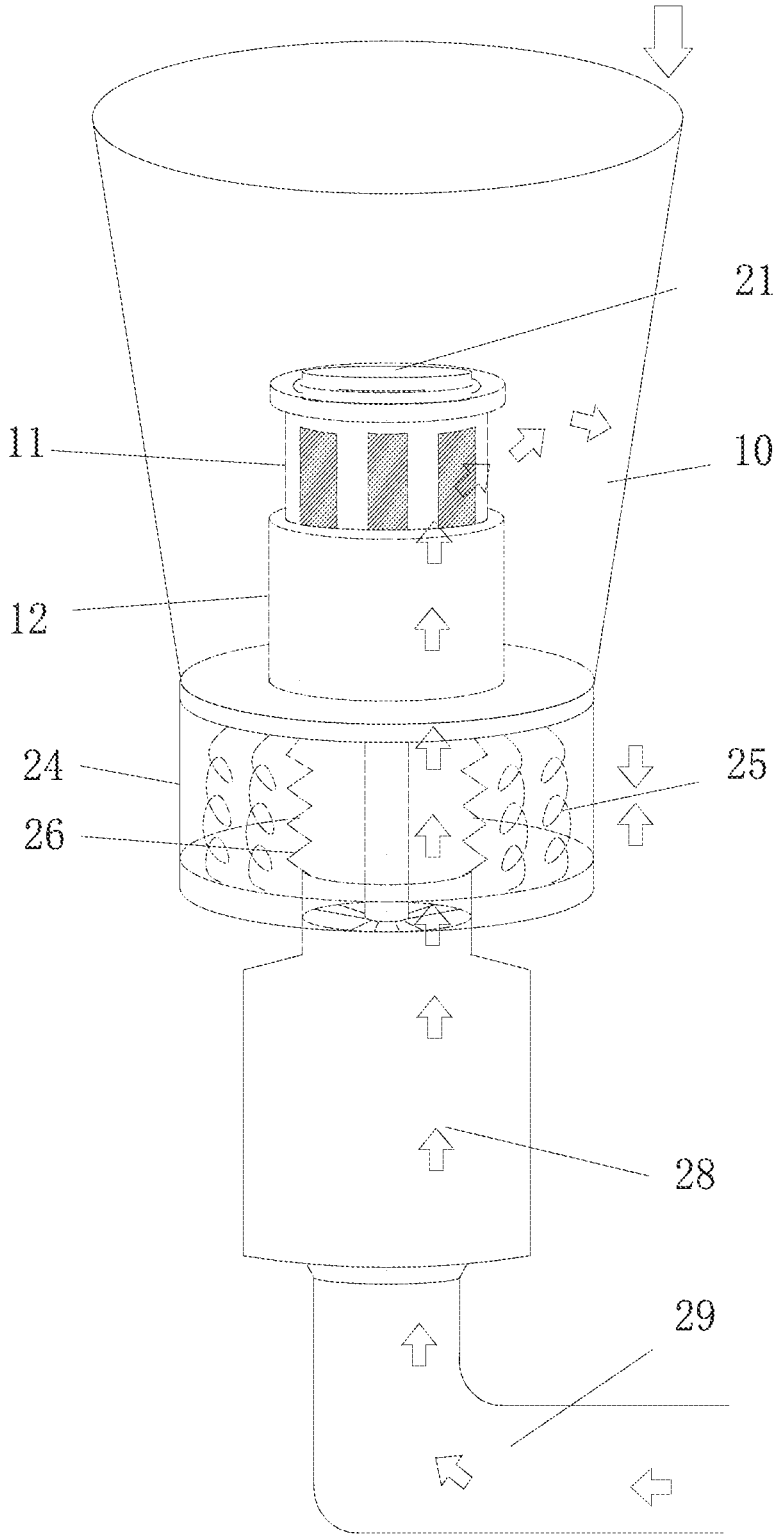
FIG. 3 is a structural schematic view of this embodiment when in circulation with a cylinder completely hidden.
Figure 4:
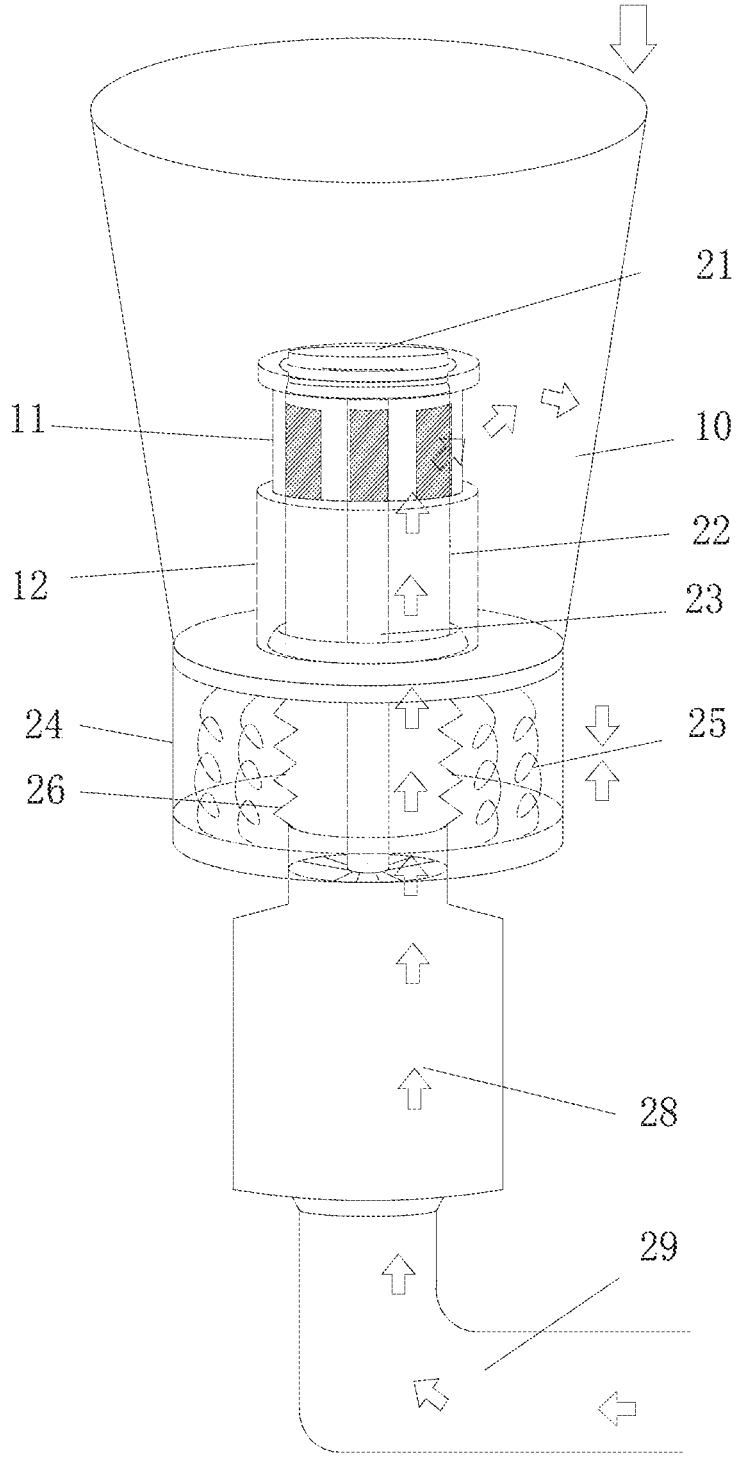
FIG. 4 is a structural schematic view of this embodiment when in circulation.
Figure 5:
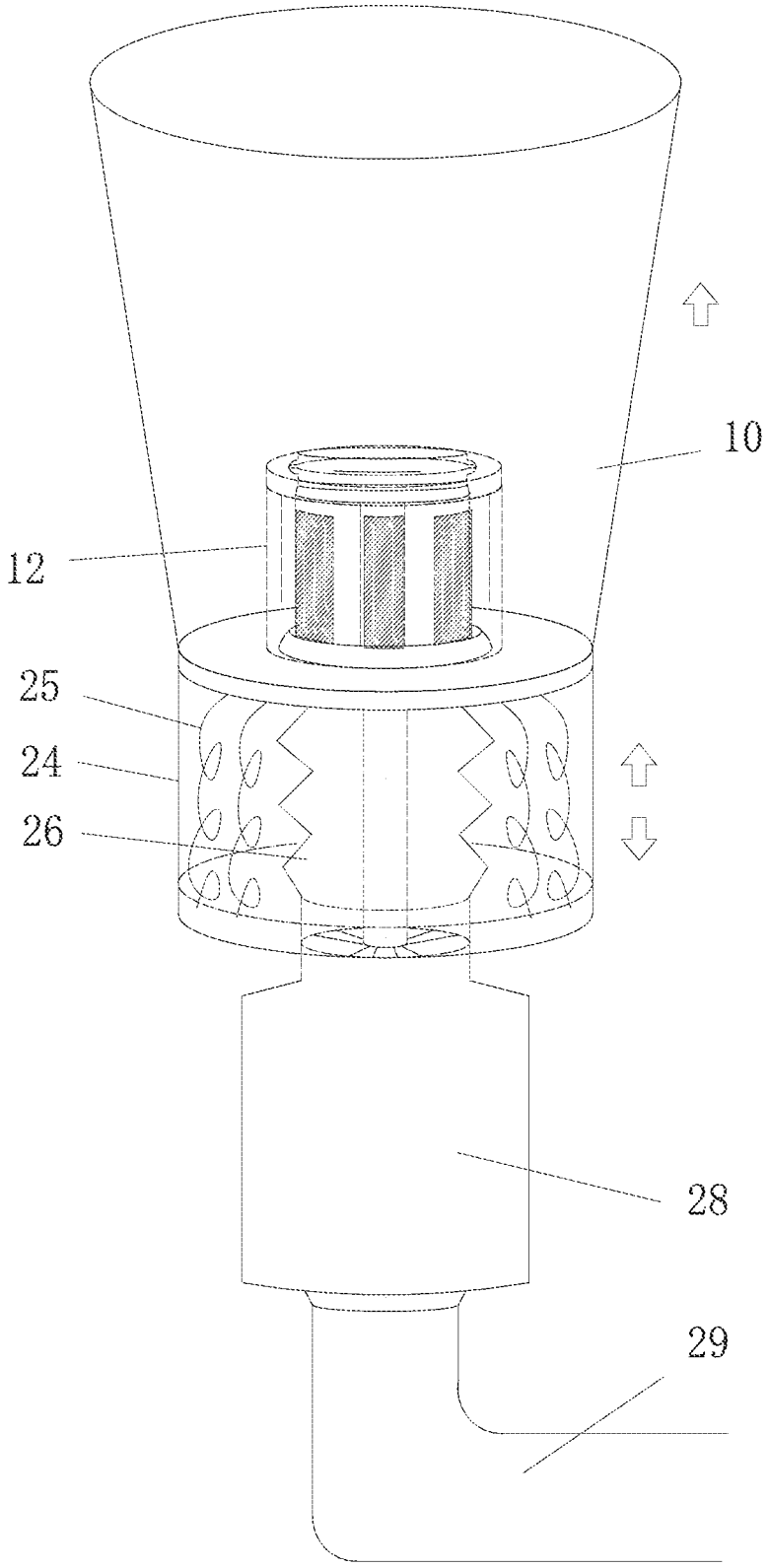
FIG. 5 is a structural schematic view of this embodiment when not in circulation.

As shown in FIG. 2, the lower body 20 comprises a capping plug 21, a rigid cylinder 22, an outer retractable tube 24, an inner retractable tube 26, an internal channel 28 and a rubber connecting tube 29, wherein the outer retractable tube 24 comprises a top plate 24*a*, a bottom plate 24*b* and a side wall 24*c* for connecting the two, a spring 25 is provided between the top plate 24*a* and the bottom plate 24*b*, the rigid cylinder 22 is arranged on the top plate 24*a*, and the rigid cylinder 22 is made of a solid material, provided that same can provide a supporting function, such as a stainless steel material, and same does not easily rust if the stainless steel material is used. The rigid cylinder 22 is internally provided with a channel, and the inner retractable tube 26 is provided inside the outer retractable tube 24 and is in communication with the rigid cylinder 22. The inner retractable tube 26 is made of an elastic material, such as a rubber material, and if a rubber material is used, the cost is low, the elasticity is better and the service life is prolonged. The spring 25 is located outside the inner retractable tube 26, a second leakproof ring 212 is provided at the connection between the rigid cylinder 22 and the top plate 24*a*, a support foundation 27 is arranged on the bottom plate 24*b*, a support cylinder 23 is arranged on the support foundation 27, the support cylinder 23 passes through the inner retractable tube 26 and extends into the rigid cylinder 22, the capping plug 21 is fixedly arranged at the top of the support cylinder 23, and the capping plug 21 is fixedly connected to the top of the rigid cylinder 22; a first leakproof ring 211 is provided at the connection between the capping plug 21 and the rigid cylinder 22, the rigid cylinder 22 is located inside the lifting member 11, and an outer side wall of the capping plug 21 is snap-fitted with an inner side wall of the top of the lifting member 11 by fitting a snap-in area 14 with a raised area 210; and in this embodiment, the snap-in area 14 is provided on the inner side wall of the top of the lifting member 11, and the raised area 210 is provided on the outer side wall of the capping plug 21. The internal channel 28 is fixedly connected to the bottom plate 24*b* and is in communication with the rigid cylinder 22, and the rubber connecting tube 29 is in communication with the bottom of the internal channel 28.

When filling needs to be carried out, the upper body 10 is pressed downwards, the bottom of the upper body 10 directly acts on the top plate 24*a* of the outer retractable tube 24, the top plate 24*a* moves downwards, so that the inner and outer retractable tubes 26, 24 are compressed, and at the same time, the spring 25 is also compressed; since the fixed member 12 is fixed to the inner bottom face of the upper body 10, the fixed member 12 moves downwards as the upper body 10 moves downwards; and since the bottom plate 24*b* is fixedly arranged on the internal channel 28, the support foundation 27 is arranged on the bottom plate 24*b*, and the support cylinder 23 is fixedly arranged on the support foundation 27, the support cylinder 23 does not move downwards as the upper body 10 moves downwards, and at this time, the lifting member 11 moves relative to the fixed member 12, and the passage hole 16 is exposed. At this time, the liquid can flow from the rubber connecting tube 29, the internal channel 28, the inner retractable tube 26 and the cylinder 22 to the filling passage channel 15, and is then discharged from the passage hole 16. One end of the rubber connecting tube 29 may be provided with a driving source, such as a liquid pump, so as to control the liquid/semi-liquid, such that same flows to the passage hole 16 of the upper body 10.

After filling is completed, the acting force for pressing the upper body 10 downwards is removed, the spring 25 drives the bottom plate 24*a* to move upwards, the bottom plate 24*a* then controls the bottom of the upper body 10, such that same moves upwards until the fixed member 12 abuts against the lower end face of the boss 13, and at this time, the passage hole 16 is blocked by the fixed member 12, and at this time, filling cannot be carried out.

The above embodiments are merely used for illustrating the technical concept and features of the present invention, and are intended to allow those who are familiar with this technique to understand and implement the content of the present invention, without limiting the scope of protection of the present invention; and any equivalent changes or modifications made according to the spirit of the present invention should all be included within the scope of protection of the present invention.

The invention claimed is:

1. A bottom-to-top liquid filling system comprising an upper body and a lower body;

wherein the upper body comprises a fixed member and a lifting member; the fixed member is fixedly arranged on an inner bottom face of the upper body; a passage hole is arranged in a side wall of the lifting member; a filling passage channel is arranged in the middle of the lifting member; and the filling passage channel passes through the bottom of the upper body; and the lower body comprises a capping plug and a rigid cylinder; the capping plug is fixedly connected to the rigid cylinder; the rigid cylinder is internally provided with a channel; and an outer side wall of the capping plug is able to be snap-fitted with an inner side wall of the lifting member.

2. The bottom-to-top liquid filling system of claim 1, wherein a first leakproof ring is provided at the connection between the capping plug and the rigid cylinder.

3. The bottom-to-top liquid filling system of claim 1, wherein a second leakproof ring is provided at the connection between the rigid cylinder and the top of the outer retractable tube.

4. The bottom-to-top liquid filling system of claim 1, wherein an annular boss is provided on an outer side of the top of the lifting member; and a lower end face of the boss and an upper end face of the fixed member vertically correspond to and are capable of coming into contact with each other.

5. The bottom-to-top liquid filling system of claim 1, wherein a limiting projection is provided on an outer side of the bottom of the lifting member; an inner side wall of the fixed member is provided with a sliding groove; the sliding groove starts from the bottom of the fixed member and terminates at an upper part of the inner side wall of the fixed member; and the limiting projection is slidable up and down in the sliding groove.

6. The bottom-to-top liquid filling system of claim 1, wherein the outer side wall of the capping plug is snap-fitted with the inner side wall of the lifting member by fitting a snap-in area with a raised area.

7. The bottom-to-top liquid filling system of claim 1, wherein the lower body further comprises an outer retractable tube and an inner retractable tube; the outer retractable tube is internally provided with a spring for controlling the expansion thereof; the rigid cylinder is arranged at the top of the outer retractable tube, and the inner retractable tube is arranged inside the outer retractable tube.

8. The bottom-to-top liquid filling system of claim 7, wherein a support foundation is arranged at the bottom of the outer retractable tube; a support cylinder is arranged on the support foundation; the support cylinder passes through the inner retractable tube and extends into the rigid cylinder; and the capping plug is fixedly arranged at the top of the support cylinder.

9. The bottom-to-top liquid filling system of claim 7, wherein the inner retractable tube is made of an elastic material.

10. The bottom-to-top liquid filling system of claim 7, further comprising an internal channel and a rubber connecting tube; wherein the internal channel is fixedly connected to the bottom of the outer retractable tube and is in communication with the rigid cylinder; and the rubber connecting tube is in communication with the bottom of the internal channel.

11. A lower structure of a bottom-to-top liquid filling system, comprising a lower body; wherein the lower body comprises a capping plug and a rigid cylinder; the capping plug is fixedly connected to the rigid cylinder; the rigid cylinder is internally provided with a channel, and an outer side wall of the capping plug is able to be snap-fitted with an inner side wall of a lifting member.

12. The lower structure of a bottom-to-top liquid filling system of claim 11, wherein a first leakproof ring is provided at the connection between the capping plug and the rigid cylinder.

13. The lower structure of a bottom-to-top liquid filling system of claim 11, wherein the outer side wall of the capping plug is snap-fitted with the inner side wall of the lifting member by fitting a snap-in area with a raised area.

14. The lower structure of a bottom-to-top liquid filling system of claim 11, further comprising an internal channel and a rubber connecting tube; wherein the internal channel is fixedly connected to the bottom of the outer retractable tube and is in communication with the rigid cylinder; and the rubber connecting tube is in communication with the bottom of the internal channel.

15. The lower structure of a bottom-to-top liquid filling system of claim 11, comprising an outer retractable tube and an inner retractable tube; wherein the outer retractable tube is internally provided with a spring for controlling the expansion thereof; the rigid cylinder is arranged at the top of the outer retractable tube; and the inner retractable tube is arranged inside the outer retractable tube.

16. The lower structure of a bottom-to-top liquid filling system of claim 15, wherein a support foundation is arranged at the bottom of the outer retractable tube; a support cylinder is arranged on the support foundation; the support cylinder passes through the inner retractable tube and extends into the rigid cylinder; and the capping plug is fixedly arranged at the top of the support cylinder.

17. The lower structure of a bottom-to-top liquid filling system of claim 15, wherein a second leakproof ring is provided at the connection between the rigid cylinder and the top of the outer retractable tube.

18. The lower structure of a bottom-to-top liquid filling system of claim 15, wherein the inner retractable tube is made of an elastic material.

* * * * *